US011814771B2

(12) United States Patent
Choi

(10) Patent No.: US 11,814,771 B2
(45) Date of Patent: Nov. 14, 2023

(54) WASHING MACHINE AND METHOD FOR CONTROLLING WASHING MACHINE

(71) Applicant: SAMSUNG ELECTRONICS CO., LTD., Suwon-si (KR)

(72) Inventor: Jun-young Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 868 days.

(21) Appl. No.: 16/614,120

(22) PCT Filed: Apr. 9, 2018

(86) PCT No.: PCT/KR2018/004155
§ 371 (c)(1),
(2) Date: Nov. 15, 2019

(87) PCT Pub. No.: WO2018/212457
PCT Pub. Date: Nov. 22, 2018

(65) Prior Publication Data

US 2020/0378052 A1 Dec. 3, 2020

(30) Foreign Application Priority Data

May 17, 2017 (KR) ..... 10-2017-0060857

(51) Int. Cl.
*D06F 37/42* (2006.01)
*D06F 39/14* (2006.01)
(Continued)

(52) U.S. Cl.
CPC ..... *D06F 33/36* (2020.02); *D06F 37/42* (2013.01); *D06F 39/14* (2013.01);
(Continued)

(58) Field of Classification Search
None
See application file for complete search history.

(56) References Cited

U.S. PATENT DOCUMENTS 4,072,867 A * 2/1978 Goodlaxson ..... D06F 37/42 307/118
5,001,910 A * 3/1991 Harmelink ..... D06F 37/42 68/12.26

(Continued)

FOREIGN PATENT DOCUMENTS

CN 101988258 A 3/2011
CN 104487622 A 4/2015

(Continued)

OTHER PUBLICATIONS

Computer Generated Translation for JP 2003290593A, Generated on Aug. 25, 2022, https://worldwide.espacenet.com/ (Year: 2022).*

(Continued)

*Primary Examiner* — Alyson M Merlino
(74) *Attorney, Agent, or Firm* — STAAS & HALSEY LLP

(57) ABSTRACT

A washing machine is disclosed. A washing machine according to one embodiment of the present invention comprises: a door for opening and closing a laundry inlet; a magnetic body included in the door; a processor; and a door lock switch module including a door lock key which moves in accordance with the opening and closing of the door so as to lock or unlock the door, a first switch electrically connected on the basis of movement of the door lock key to a locked position, and a second switch connected in series with the first switch and electrically connected in response to an approach of the magnetic body, wherein the processor receives a signal generated by connecting the first switch and the second switch, detects the locking of the door, and proceeds to perform the washing cycle process of the washing machine. Other embodiments are possible.

13 Claims, 7 Drawing Sheets

(51) Int. Cl.

| | |
|---|---|
| ***E05B 47/00*** | (2006.01) |
| ***D06F 34/20*** | (2020.01) |
| ***D06F 33/36*** | (2020.01) |
| *D06F 103/40* | (2020.01) |
| *D06F 105/58* | (2020.01) |
| *D06F 33/74* | (2020.01) |
| *D06F 37/18* | (2006.01) |
| *D06F 37/28* | (2006.01) |

(52) U.S. Cl.

CPC ..... *E05B 47/0001* (2013.01); *D06F 33/74* (2020.02); *D06F 34/20* (2020.02); *D06F 37/18* (2013.01); *D06F 37/28* (2013.01); *D06F 2103/40* (2020.02); *D06F 2105/58* (2020.02); *E05B 2047/005* (2013.01); *E05B 2047/0067* (2013.01)

(56) References Cited

U.S. PATENT DOCUMENTS

| | | | | |
|---|---|---|---|---|
| 5,038,587 | A | 8/1991 | Harmelink | |
| 5,072,974 | A * | 12/1991 | Henne | E05C 19/022 292/201 |
| 7,150,480 | B2 | 12/2006 | Lafrenz | |
| 7,251,961 | B2 * | 8/2007 | Hapke | D06F 39/14 68/12.26 |
| 7,493,783 | B2 * | 2/2009 | Hapke | D06F 39/14 68/12.26 |
| 7,705,253 | B2 * | 4/2010 | Krieger | D06F 37/42 200/500 |
| 8,707,742 | B2 | 4/2014 | Kim et al. | |
| 8,991,877 | B2 | 3/2015 | Spiessl | |
| 9,085,845 | B2 | 7/2015 | Choi et al. | |
| 9,869,049 | B2 | 1/2018 | Park et al. | |
| 10,697,200 | B2 * | 6/2020 | Osvatic | D06F 39/14 |
| 2006/0288742 | A1 | 12/2006 | Hapke et al. | |
| 2011/0016640 | A1 | 1/2011 | Kim et al. | |
| 2014/0102149 | A1 * | 4/2014 | Park | D06F 37/42 68/12.26 |
| 2015/0167225 | A1 | 6/2015 | Park et al. | |
| 2015/0240527 | A1 * | 8/2015 | Osvatic | D06F 39/14 292/144 |
| 2015/0361690 | A1 * | 12/2015 | Hintz | A47L 15/4259 292/138 |
| 2019/0024287 | A1 | 1/2019 | Kim et al. | |

FOREIGN PATENT DOCUMENTS

| | | | | |
|---|---|---|---|---|
| CN | 106460299 | A | 2/2017 | |
| DE | 102013109620 | A1 * | 3/2015 | A47L 15/4259 |
| JP | 2003-290593 | | 10/2003 | |
| KR | 1998-028388 | | 8/1998 | |
| KR | 1999-003083 | | 1/1999 | |
| KR | 10-2014-0101129 | | 8/2014 | |
| KR | 10-2015-0001029 | | 1/2015 | |
| KR | 10-1606725 | | 3/2016 | |
| KR | 10-1708638 | | 2/2017 | |
| KR | 10-2017-0097410 | | 8/2017 | |

OTHER PUBLICATIONS

Computer Generated Translation for DE 102013109620, Generated on Aug. 25, 2022, https://worldwide.espacenet.com/ (Year: 2022).*

Korean Office Action dated Jul. 15, 2021 from Korean Application No. 10-2017-0060857.

Chinese Office Action dated Sep. 27, 2021 from Chinese Application No. 201880032550.8.

International Search Report dated Jul. 9, 2018, in corresponding International Patent Application No. PCT/KR2018/004155.

Written Opinion of the International Searching Authority dated Jul. 9, 2019 in corresponding International Patent Application No. PCT/KR2018/004155.

* cited by examiner

WASHING MACHINE AND METHOD FOR CONTROLLING WASHING MACHINE

CROSS-REFERENCE TO RELATED APPLICATIONS

This application is a U.S. National Stage Application which claims the benefit under 35 U.S.C. § 371 of International Patent Application No. PCT/KR2018/004155 filed on Apr. 9, 2018, which claims foreign priority benefit under 35 U.S.C. § 119 of Korean Patent Application No. 10-2017-0060857 filed on May 17, 2017 in the Korean Intellectual Property Office, the contents of both of which are incorporated herein by reference.

TECHNICAL FIELD

The disclosure relates to a door lock detection method of a washing machine and a washing machine performing the same, and more particularly, to a detection method of detecting a lock state of a washing machine door by a two-step verification method and a washing machine performing the same.

BACKGROUND ART

In general, a washing machine (for example, a fully automatic washing machine) includes a water tank for containing water, a washing tub rotatably installed inside the water tank and accommodating laundry, a pulsator rotatably installed inside the washing tub and generating a water flow, and a motor generating a driving force for rotating the washing tub and the pulsator, and may remove contamination of the laundry using the water flow and a detergent.

The washing machine is provided with an inlet through which the laundry may be injected into or taken out of the washing tub and is provided with a door hinge-coupled to open and close the inlet, and a top cover on which the door is seated may be provided with a door lock switch module locking the door so that the door may not be opened and closed.

The door lock switch module may lock the door by protruding a door lock bolt to the outside of the door lock switch module or unlock the door by inserting the door lock bolt into the door lock switch module.

DISCLOSURE

Technical Problem

A washing machine may perform a washing process by confirming a locked state and an unlocked state of a door However, water vapor may be introduced into a door lock switch module depending on an environmental condition in which the washing machine is installed. In this case, an error may occur at a contact at which the locked state and the unlocked state of the door are recognized.

Technical Solution

According to an embodiment of the disclosure, a washing machine includes: a washing machine door; a washing machine inlet configured to be opened and closed by movement of the washing machine door; a door lock switch module provided in the washing machine inlet to prevent separation of the washing machine door from the washing machine inlet and configured to include a door lock bolt movable to an inside of the washing machine door, a first switch operated on the basis of a position to which the door lock bolt moves according to the movement of the washing machine door, and a second switch operated on the basis of an adjacent distance of a magnetic body included in the washing machine door from the washing machine inlet; and a processor configured to control the washing machine to perform a washing process when it is identified that the washing machine door is locked on the basis of operation modes of the first switch and the second switch.

In a case in which the first switch and the second switch are connected to each other in series, the processor may be configured to control the washing machine to perform the washing process by identifying that the washing machine door is locked when both of the first switch and the second switch are short-circuited.

The processor may be configured to control the washing machine to perform the washing process when it is identified that the washing machine door is locked, on the basis of a signal generated according to the operation modes of the first switch and the second switch.

The processor may be configured to control the washing machine to output a washing machine error signal when the signal is not generated, in a case in which the door lock bolt moves to the inside of the washing machine door.

The door lock switch module may include a third switch electrically connected on the basis of movement of the door lock bolt to an unlocking position.

The processor may be configured to detect that the washing machine door is unlocked on the basis of reception of a signal generated by the connection of the third switch.

The door lock switch module may include a reed switch connected on the basis of opening and closing of the washing machine door, and the processor may be configured to move the door lock bolt to a locking position when a signal generated by the connection of the reed switch is received.

The washing machine may further include a top cover in which the washing machine inlet is formed, wherein the washing machine door is hinge-coupled to one side of the top cover to open and close the washing machine inlet.

The door lock switch module may be installed at the other side of the top cover on which the washing machine door is seated.

The magnetic body may be positioned at one end of the washing machine door adjacent to a position of the door lock switch module in a case in which the washing machine door is seated on the top cover.

The door may include a block member blocking the movement of the door lock bolt, and the block member may be provided at an inner side of the front of the washing machine door.

The movement of the door lock bolt to the locking position may be limited by the block member.

According to another embodiment of the disclosure, a method for controlling a washing machine including a door includes: moving a door lock bolt included in a door lock switch module to a locking position; confirming a locking signal generated according to a short-circuit of a first switch according to the movement of the door lock bolt and a short-circuit of a second switch connected to the first switch in series and short-circuited according to approach of a magnetic body and performing a washing process when a locked state of the door is confirmed.

The method may further include generating an error signal in a case in which the locking signal is not received, after the door lock bolt moves to the locking position.

The washing machine may further include a third switch electrically connected on the basis of movement of the door lock bolt to an unlocking position, and the method may further include detecting that the door is unlocked on the basis of reception of a signal generated by the connection of the third switch.

The washing machine may further include a reed switch connected on the basis of opening and closing of the door, and the method may further include moving the door lock bolt to the locking position when a signal generated by the connection of the reed switch is received.

Advantageous Effects

According to an embodiment of the disclosure, the washing machine may confirm the locked state of the door on the basis of connection of a contact detecting movement of the door lock bolt to the locking position and connection of a contact connected to the abovementioned contact in series and connected according to approach of the magnetic body included in the door.

BEST MODE

Figure 1:
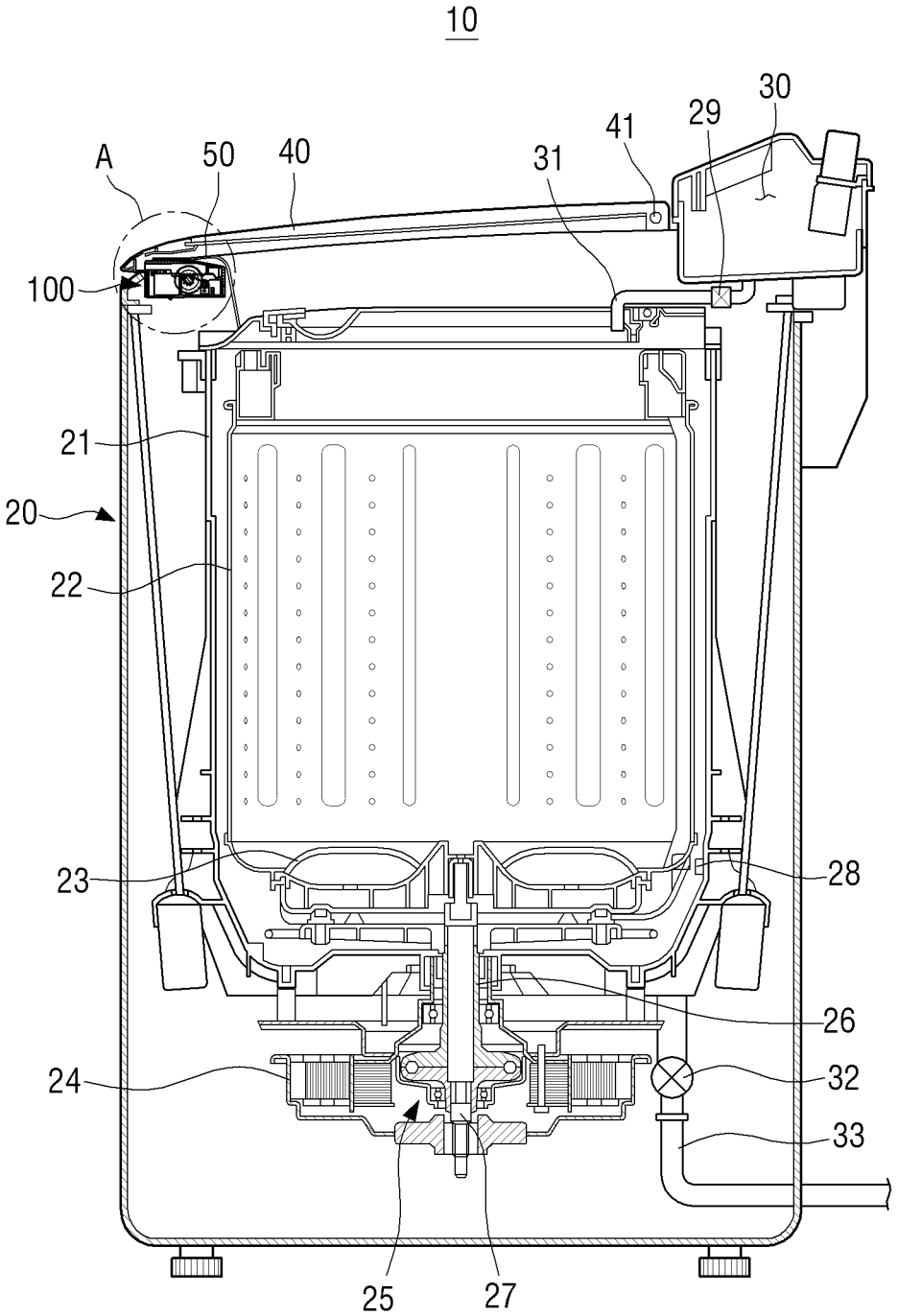
FIG. 1 is a cross-sectional view illustrating a closed state of a door in a washing machine according to an embodiment.

Hereinafter, various embodiments of the disclosure will be described with reference to the accompanying drawings. It is to be understood that embodiments and terms used in these embodiments do not limit a technology described in the disclosure to a specific embodiment, and include various modifications, equivalents, and/or substitutions of corresponding embodiments. Throughout the accompanying drawings, similar components will be denoted by similar reference numerals. Singular forms may include plural forms unless the context clearly indicates otherwise. In the disclosure, an expression "A or B", "at least one of A and/or B", or the like, may include all possible combinations of items enumerated together. Expressions "first", "second", or the like, may indicate corresponding components regardless of a sequence and/or importance of the corresponding components, will be used only to distinguish one component from the other components, and do not limit the corresponding components. When it is mentioned that any component (for example, a first component) is "(operatively or communicatively) connected" to another component (for example, a second component), it is to be understood that any component may be directly connected o another component or may be coupled to another component through the other component (for example, a third component).

An expression "configured to" used in the disclosure may be used to be interchangeable with an expression "suitable for", "having the capacity to" "adapted to", "made to", "capable of", or "designed to" in terms of hardware or software depending on a situation. In some situations, an expression "a device configured to" may mean that the device may "do" together with other devices or components. For example, a "processor configured (or set) to perform A, B, and C" may mean a dedicated processor (for example, an embedded processor) for performing the corresponding operations or a generic-purpose processor (for example, a central processing unit (CPU) or an application processor) that may perform the corresponding operations by executing one or more software programs stored in a memory device.

Figure 2:
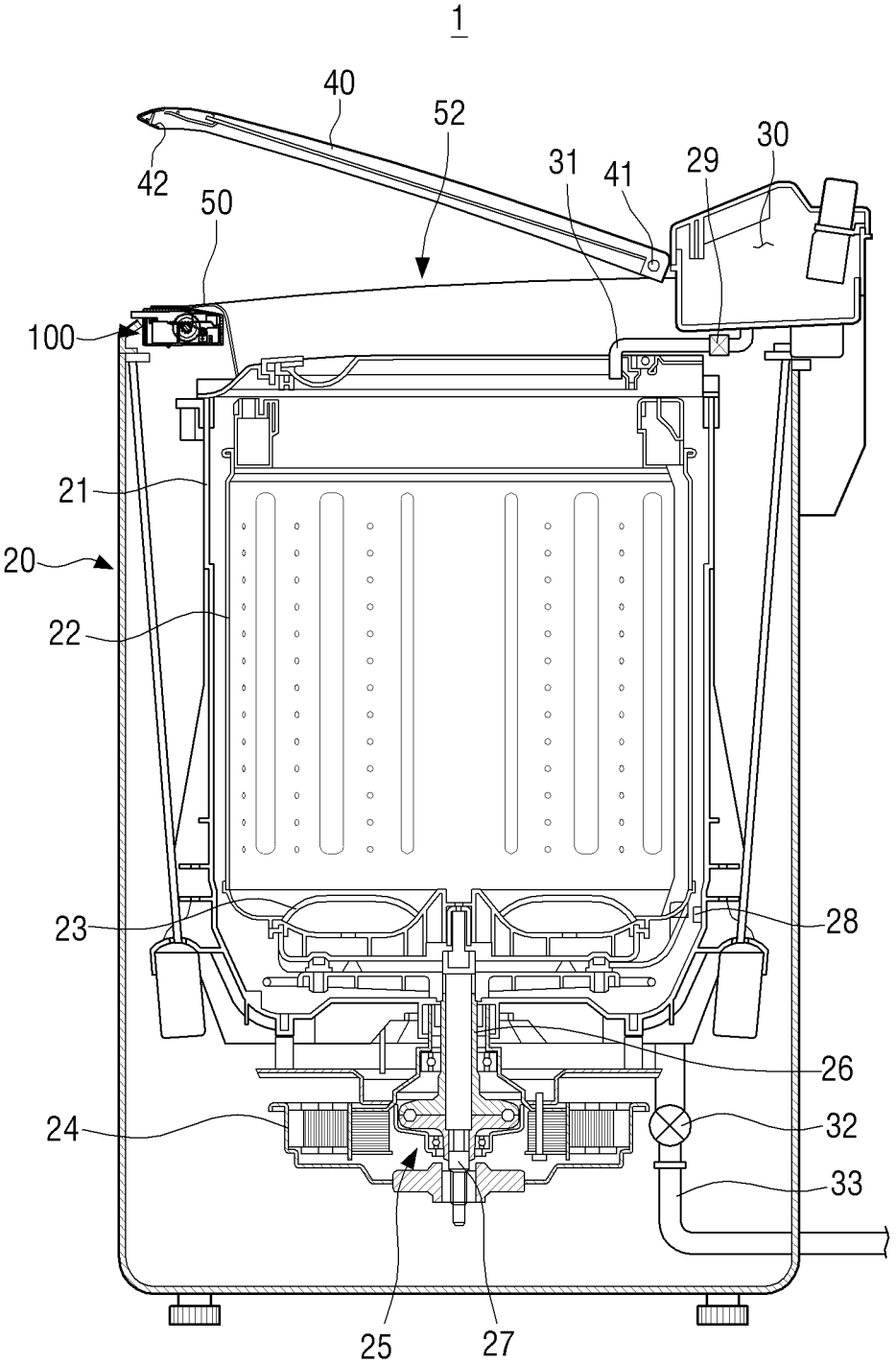
FIG. 2 is a cross-sectional view illustrating an opened state of the door in the washing machine according to an embodiment.

FIG. 1 is a cross-sectional view illustrating a closed state of a door in a washing machine according to an embodiment, and FIG. 2 is a cross-sectional view illustrating an opened state of the door in the washing machine according to an embodiment.

Referring to FIGS. 1 and 2, a washing machine 10 according to an embodiment may include a body 20 having an approximately box shape and forming an appearance, a water tank 21 installed inside the body 20 and containing water (for example, washing water or rinsing water), and a washing tub 22 rotatably installed inside the water tank 21 and containing laundry.

A pulsator 23 rotatably installed and rotating left or right (turning forward or reverse) to generate a water flow may be installed at a bottom portion of the washing tank 22.

A first motor 24 generating a driving force for rotating the washing tub 22 and the pulsator 23 and a power switching device 25 for transmitting the driving force generated from the first motor 24 to the washing tub 22 and the pulsator 23 may be installed outside a lower side of the water tank 21.

The first motor 24 may be a direct drive-type motor having a variable speed function. The first motor 24 may selectively transfer the driving force to the washing tub 22 or the pulsator 23 according to an ascend or descent operation of the power switching device 25. A hollow dehydration shaft 26 may be coupled to the washing tub 22, and a washing shaft 27 installed in a hollow portion of the dehydration shaft 26 is coupled to the pulsator 23 through a washing shaft coupling portion (not illustrated).

In addition, the first motor 24 may be a universal motor including a field coil and an armature, a brushless direct current (BLDC) motor including a permanent magnet and an electric magnet, or the like. However, the first motor 24 is not limited thereto, and may be any motor that may be used in the washing machine 10. For example, in the washing machine 10, a belt-type motor may be configured.

A water level sensor 28 sensing a frequency converted depending on a water level to sense an amount of water in the water tank 21 may be installed inside a lower side of the water tank 21.

In addition, a water supply valve 29 and a detergent box 30 each supplying water and a detergent to the water tank 21 may be installed above the water tank 21, and the water supply valve 29 may be installed in the middle of a water supply pipe 31 supplying the water into the water tank 21 to control the water supply. A drain valve 32 and a drain pipe 33 for draining the water in the water tank 21 may be installed below the water tank 21.

In addition, a door 40 opening and closing an upper surface of the body 20 may be installed at an upper portion of the body 20, a top cover 50 detached or seated depending on whether the door 40 is opened or closed may be installed at an upper side of the body 20, and an inlet 52 may be formed in the top cover 50 so that laundry may be injected into or taken out of the washing tub 22.

The door 40 may be hinge-coupled to the top cover 50 to open and close the inlet 52 by a hinge member 41 provided at one side thereof. In addition, a block member 42 blocking a door lock bolt (not illustrated) so that the door lock bolt does not further move forward when the door 40 is closed may be provided at an inner side of the front of the door 40. In addition, the door 40 may include a magnetic body (not illustrated) adjacent to a place at which the block member 42 is positioned and generating a magnetic force.

A door lock switch module 100 locking the door 40 so that opening and closing of the door 40 are impossible during an operation of the washing machine 10 may be installed at one side of the front of the top cover 50 on which the door 40 is seated.

Generally, a fully automatic washing machine may have a structure in which the door 40 is installed above the top cover 50 to be opened and closed upwardly. On the other hand, a drum washing machine may have a structure in which a door is installed on a front surface of an outer case to be opened and closed forwardly.

Hereinafter, the disclosure will be described using the fully automatic washing machine as an example.

According to an embodiment, the door 40 of the washing machine 10 may be divided into an opened state and a closed state. The opened state may refer to, for example, a state in which the door 40 rotates in a first direction using the hinge member 41 as a rotation axis, such that the laundry may be injected into or taken out from the washing tub 22, as illustrated in FIG. 2. The closed state may refer to, for example, a state in which the door 40 rotates in a second direction using the hinge member 41 as a rotation axis to cover the water tank 21 and the washing tub 22, as illustrated in FIG. 1.

The closed state of the door 40 may be again divided into a locked state and an unlocked state. For example, the locked state may be a state in which the door 40 is not opened even though a user applies an external force to the door 40 to open the door 40. The unlocked state may be a state in which the door 40 may be switched to the opened state when the user applies the external force to the door 40 to open the door 40.

Figure 3:
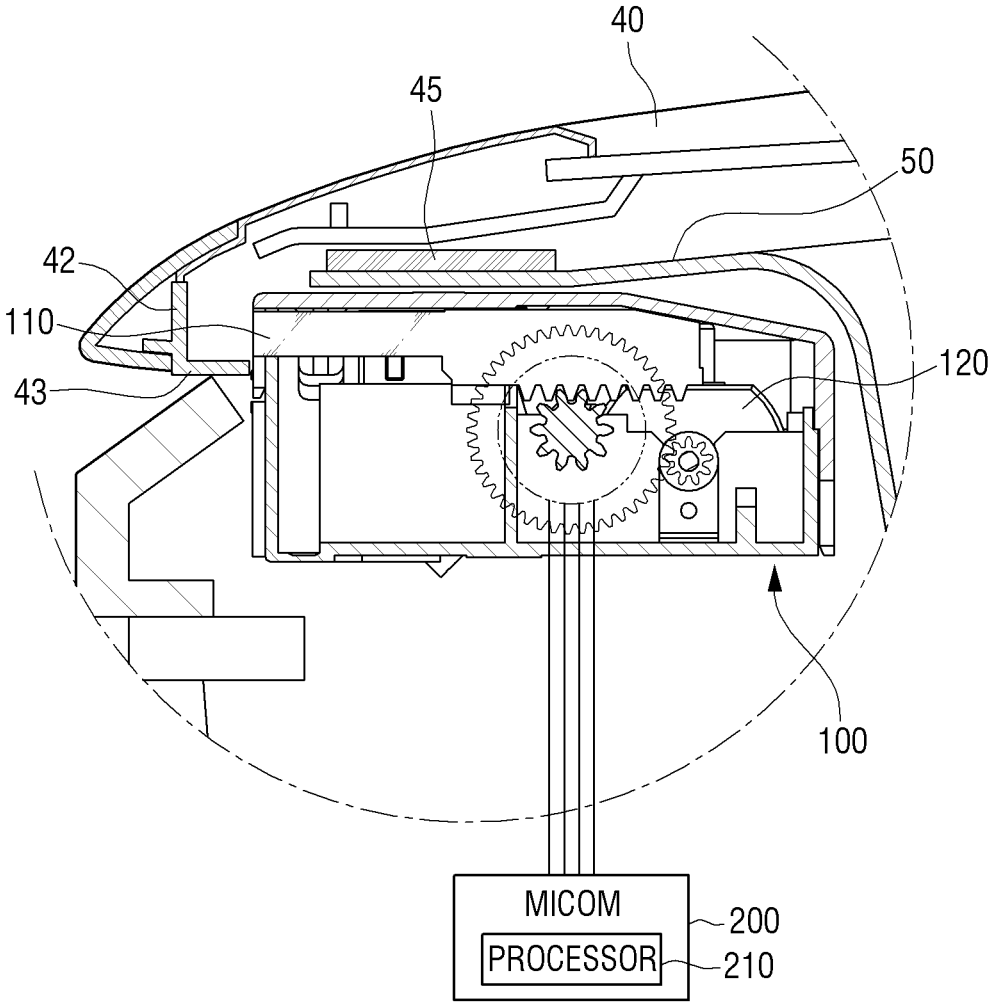
FIGS. 3 to 4B are views for describing a case in which the door of the washing machine according to an embodiment is in an unlocked state.
Figure 4A:
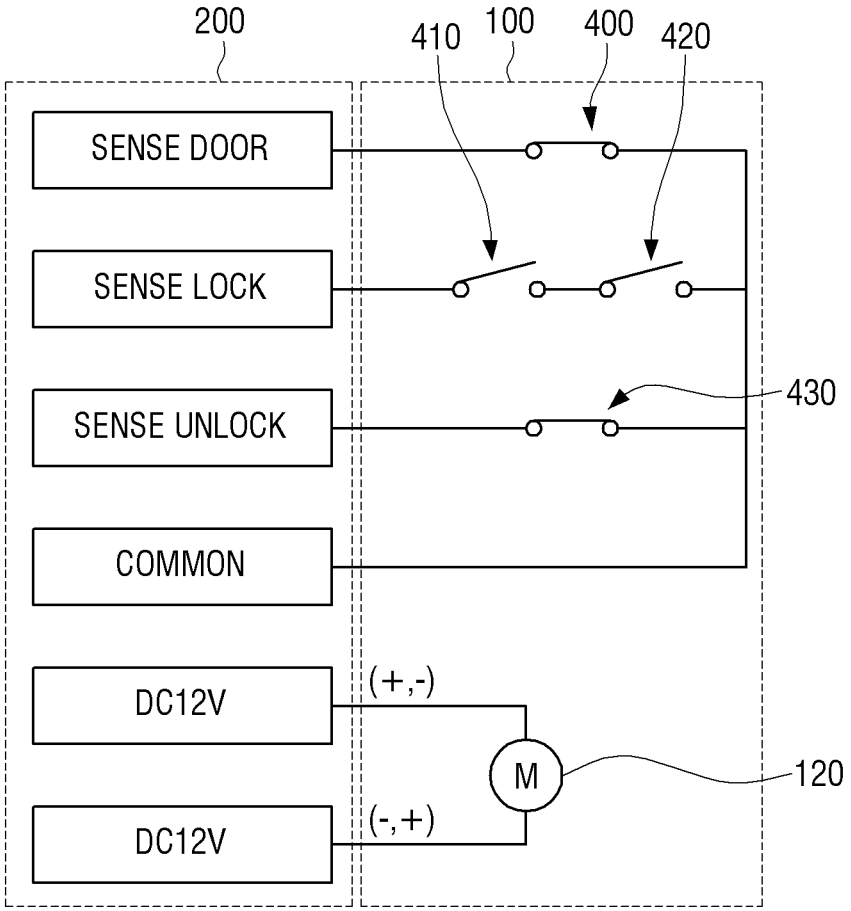
Figure 4B:
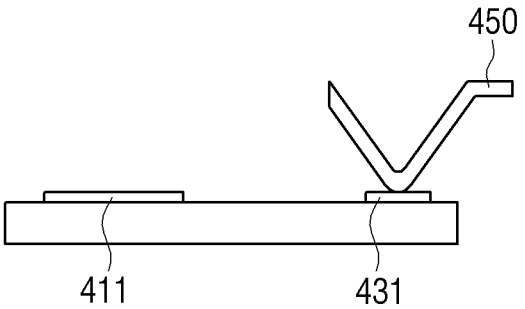

FIGS. 3 to 4B are views for describing a case in which the door of the washing machine according to an embodiment is in an unlocked state.

FIG. 3 is an enlarged view of region A of FIG. 1.

Referring to FIG. 3, the door lock switch module 100 may include a door lock bolt 110 moving forward and backward according to movement of the door 40, that is, the opening and closing of the door 40 to lock or unlock the door 40 and a driving device (for example, a second motor 120) capable of reciprocating the door lock bolt 110. The second motor 120 may transfer a driving force generated using, for example, a combination of one or more gears to the door lock bolt 110.

The door lock switch module 100 may be electrically connected to a microcomputer 200 (hereinafter, referred to as a micom). The micom 200 may include, for example, a processor 210, a memory, and the like. However, the micom 200 is not limited thereto.

The processor 210 may drive, for example, an application program to control hardware or software components connected to the processor 210.

According to an embodiment, in a case in which the door lock bolt 110 is inserted into the door lock switch module 100, the user may open the door 40 of the washing machine 10. In addition, in a case in which the door lock bolt 110 protrudes to the outside of the door lock switch module 100 up to a position at which it may be in contact with a locking portion 43 provided at one side of the door 40, the user may not open the door of the washing machine 10. The door lock bolt 110 may protrude up to, for example, a point at which it is in contact with the block member 42. That is, in a case in which the door lock bolt 110 protrudes up to, for example, the point at which it is in contact with the block member 42, when the user rotates the door 40 in the first direction using a hinge member (for example, the first hinge member 41 of FIG. 1) as an axis, the door lock bolt 110 is in contact with the locking portion 43, and the door 40 does not rotate. The rotation in the first direction may refer to, for example, rotation in a direction in which the door 40 becomes distant from the washing machine inlet 52.

According to an embodiment, the door lock switch module 100 may include a reed switch (not illustrated) sensing the opening and closing of the door 40.

The reed switch may have, for example, a form in which two magnetic reed pieces sealed in a glass pipe are included. The reed switch may be short-circuited because the two magnetic reed pieces are attracted to each other when a magnetic body approaches the surrounding of the read switch in a state in which the two magnetic reed pieces are not in contact with each other by elasticity of a spring. In addition, when the magnetic body becomes distant from the reed switch, the two magnetic reed piece may be again opened.

According to an embodiment, the door 40 may include a magnetic body 45 installed adjacent to the place at which the block member 42 is positioned. Therefore, when the door becomes the closed state, such that the magnetic body 45 included in the door 40 is adjacent to the door lock switch module 100, the reed switch included the door lock switch module 100 may be short-circuited. The processor 210 of the washing machine 10 may confirm that the door 40 is changed from the opened state to the closed state, when a signal generated by a short-circuit of a contact of the reed switch is received.

FIG. 4A is a view for describing an electrical connection relationship between the micom 200 and the door lock switch module 100.

Referring to FIG. 4A, in a case in which the door 40 is changed from the opened state to the closed state by the user, the reed switch 400 may be short-circuited. That is, a contact of the reed switch 400 may be connected according to the approach of a magnetic material (for example, the magnetic material 45 of FIG. 3) included in a door (for example, the door 40 of FIG. 3).

According to an embodiment, in a case in which the door (for example, the door 40 of FIG. 3) is in the opened state or is changed from the opened state to the closed state but is yet in the unlocked state, a third switch 430 sensing the unlocked state may be short-circuited. A processor (for example, the processor 210 of FIG. 3) may confirm that the door (for example, the door 40 of FIG. 3) is in the unlocked state, when a signal generated by the short-circuit of the reed switch 400 and an unlocking signal generated by connection of the third switch 430 are received.

FIG. 4B is a view illustrating an embodiment of a first switch 410 and the third switch 430 included in the door lock switch module 100.

According to an embodiment, the first switch 410 and the third switch 430 may include a first switch contact 411 and a third switch contact 431, respectively. In addition, a moving contact 450 may be in selective contact with the first switch contact 411 and the third switch contact 431.

For example, when the first switch contact 411 and the moving contact 450 are electrically connected to each other, the first switch 410 may be short-circuited, and when the third switch contact 431 and the moving contact 450 are electrically connected to each other, the third switch 430 may be short-circuited.

The moving contact 450 may reciprocate between the first switching contact 411 sensing the locked state and the third switch contact 431 sensing the unlocked state by, for example, mechanically interworking with a door lock bolt (for example, the door lock bolt 110 of FIG. 3).

That is, in a case in which the door lock bolt (for example, the door lock bolt 110 of FIG. 3) is present in the door lock switch module 100, the moving contact 450 may be in contact with the third switch contact 431 sensing the unlocked state. In addition, when the door lock bolt (for example, the door lock bolt 110 of FIG. 3) moves to the outside of the door lock switch module 100 on the basis of the control of the processor (for example, the processor 210 of FIG. 3), the moving contact 450 may move toward the first switch contact 411 sensing the locked state of the door on the basis of the movement of the door lock bolt (for example, the door lock bolt 110 of FIG. 3).

However, a structure of using the moving contact 450 that may reciprocate by interworking with the movement of the door lock bolt (for example, the door lock bolt 110 of FIG. 3) to sense the locked state and the unlocked state of the door (for example, the door 40 of FIG. 3) is only an example, and is not limited thereto.

Figure 5:
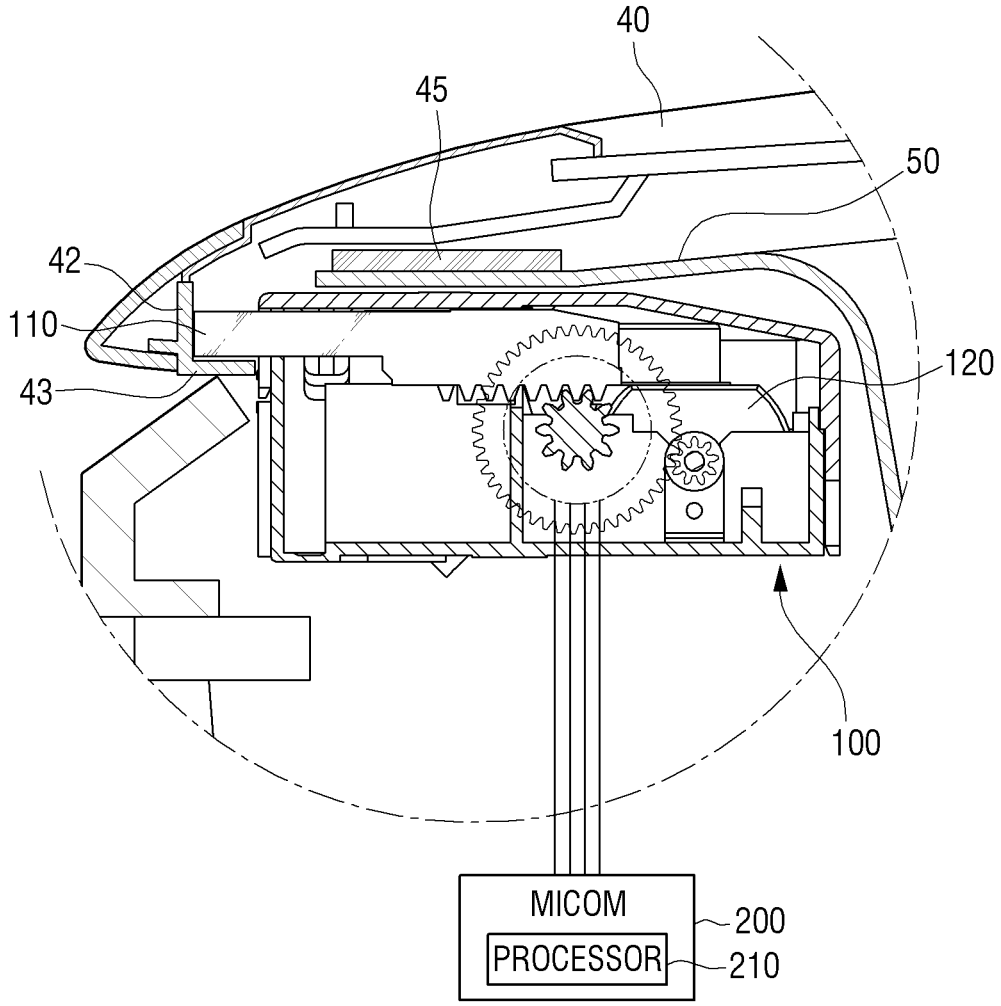
FIGS. 5 to 6B are views for describing a case in which the door of the washing machine according to an embodiment is in a locked state.
Figure 6A:
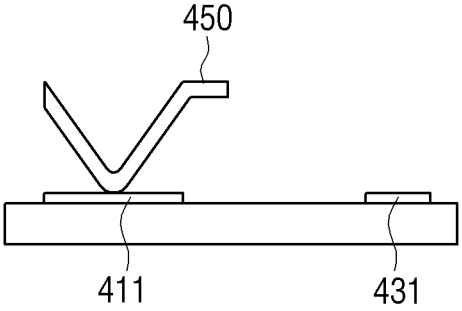
Figure 6B:
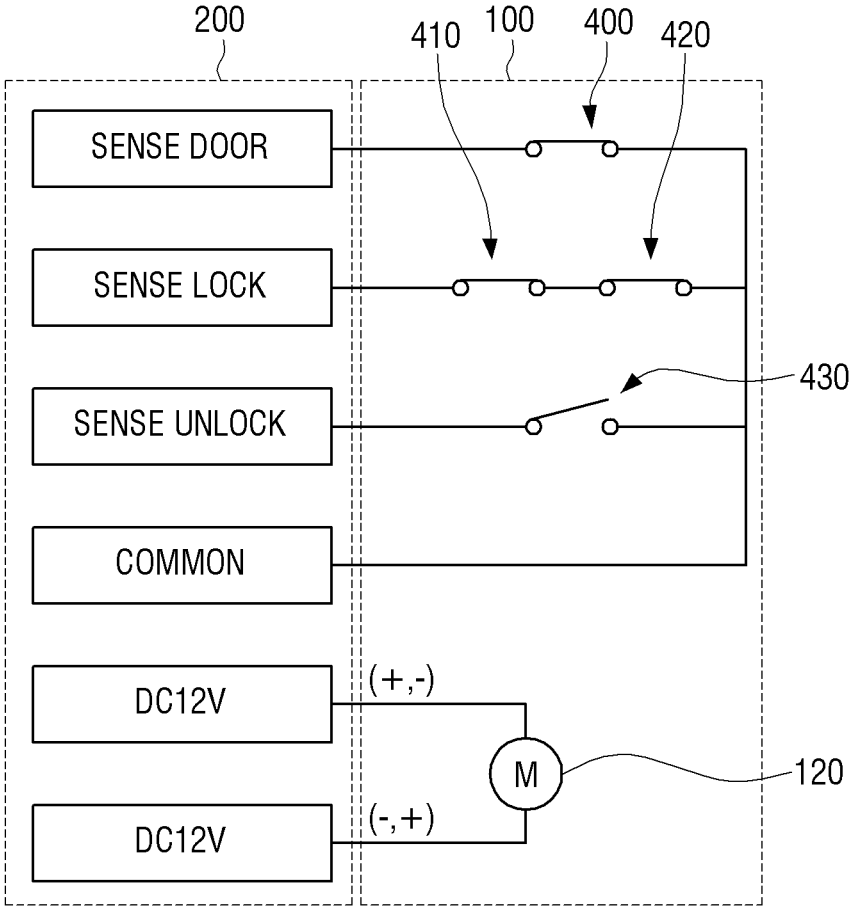

FIGS. 5 to 6B are views for describing a case in which the door of the washing machine according to an embodiment is in a locked state.

Referring to FIG. 5, when a signal generated by connection of a contact of a reed switch (for example, the reed switch 400 of FIG. 4) according to the approach of the magnetic body 45 included in the door 40 is received, the processor 210 may move the door lock bolt 110 to the outside of the door lock switch module 100 using the second motor 120.

For example, the processor 210 may protrude the door lock bolt 110 to the outside of the door lock switch module 100 by applying a voltage of direct current (DC) 12V to rotate the second motor 120 in the first direction.

According to an embodiment, in a case in which the processor 210 applies the voltage of DC 12V, the second motor 120 may rotate in the second direction, and the door lock bolt 110 may be inserted into the door lock switch module 100. In a case in which the door 40 is in the closed state, the door lock bolt 110 may move up to a point at which it is in contact with the block member 42.

According to an embodiment, if the door lock bolt 110 protrudes to the outside of the door lock switch module 100 in a state in which the door 40 is closed, when the user tries to open the washing machine inlet 52 by rotating the door 40 in the first direction using the hinge member 41 as the axis, the locking portion 43 provided in the door 40 and the door lock bolt 110 are in contact with each other, such that the door 40 does not move. That is, the door 40 of the washing machine 10 may become the locked state.

Referring to FIGS. 6A and 6B, the moving contact 450 may also move according to the movement of the door lock bolt (for example, the door lock bolt 110 of FIG. 5). For example in a case in which the processor (for example, the processor 210 of FIG. 5) moves the door lock bolt (for example, the door lock bolt 110 of FIG. 5) to the outside of the door lock switch module 100 using the second motor 120, the moving contact 450 may move from the third switch contact 431 sensing the unlocked state toward the first switch contact 411 sensing the locked state. When a locking signal generated by contact between the moving contact 450 and the first switch contact 411 is received, the processor (for example, the processor 210 of FIG. 5) may confirm that the door 40 of the washing machine (for example, the washing machine 10 of FIG. 1) is in the locked state. In addition, the processor (for example, the processor 210 of FIG. 5) may state a washing process.

However, in a case in which the door (for example, the door 40 of FIG. 5) is not actually in the closed state, even though the door lock bolt (for example, the door lock bolt 110 of FIG. 5) moves, the first switch 410 may be short-circuited, and a signal erroneously indicating that the moving contact 450 is in contact with the first switch contact 411 in a state in which the moving contact is not in contact with the first switch contact 411 may be generated.

For example, moisture may penetrate into the door lock switch module 100 due to steam or an external temperature difference according to an environmental condition in which the washing machine (for example, the washing machine 10 of FIG. 1) is installed or a heater operation, and a short-circuit may be generated between some contacts due to the moisture, such that the error described above may occur.

Referring to FIG. 6B, in the washing machine (for example, the washing machine 10 of FIG. 1) according to an embodiment, a second switch 420 may be connected in series to the first switch 410 sensing the locked state so that the washing process does not start in a case in which the door (for example, the door 40 of FIG. 5) is not in the locked state. The second switch 420 may sense, for example, a change in a magnetic field to automatically change connection and disconnection of the second switch 420. Therefore, in a case in which the magnetic body (for example, the magnetic body 45 of FIG. 5) provided at one side of the door (for example, the door 40 of FIG. 5) approaches the second switch 420, the second switch 420 may sense the approach of the magnetic body and be connected.

The second switch 420 may be, for example, the reed switch described above. However, the second switch 420 is not limited thereto. For example, the second switch 420 may be a sensor (for example, a hall sensor, a tunneling magneto resistance (TMR) magnetic sensor, or the like) detecting the presence or absence of a magnetic field, and may have a structure in which a contact is connected when the magnetic field is detected and is disconnected when the magnetic field is not detected.

According to an embodiment, when a locking signal generated when the first switch 410 sensing the locked state is connected and at the same time, the second switch 420 is connected is received, the processor (for example, the processor 210 of FIG. 5) may identify that the door (for example, the door 40 of FIG. 5) of the washing machine (for example, the washing machine 10 of FIG. 1) is in the locked state. Therefore, the processor (for example, the processor 210 of FIG. 4) may protrude the door lock bolt (for example, the door lock bolt 110 of FIG. 5), confirm the reception of the signal by a predetermined number of times, identify that the door (for example, the door 40 of FIG. 5) is in the unlocked state when the locking signal is not received, and generate an error meaning that the washing process may not be performed.

The washing machine 10 may reduce a malfunction in which the washing process is performed in a state in which the door (for example, the door 40 of FIG. 5) is opened by confirming the locked state of the door (for example, the door 40 of FIG. 5) using the first switch 410 and the second switch 420 electrically connected to the first switch 410 in series, as described above.

However, a method of detecting the locked state and the unlocked state of the washing machine door 40 by the washing machine 10 is not limited thereto. For example, the processor 210 may identify that the door 40 is in the locked state when the first switch 410 and the third switch 430 are opened. In addition, the processor 210 may identify that the door 40 is in the opened state when the second switch 420 is opened. As described above, the washing machine 10 may identify the locked state, the unlocked state, and the like, of the door 40 according to various operation modes of the first switch 410, the second switch 420, and the third switch 430.

Figure 7A:
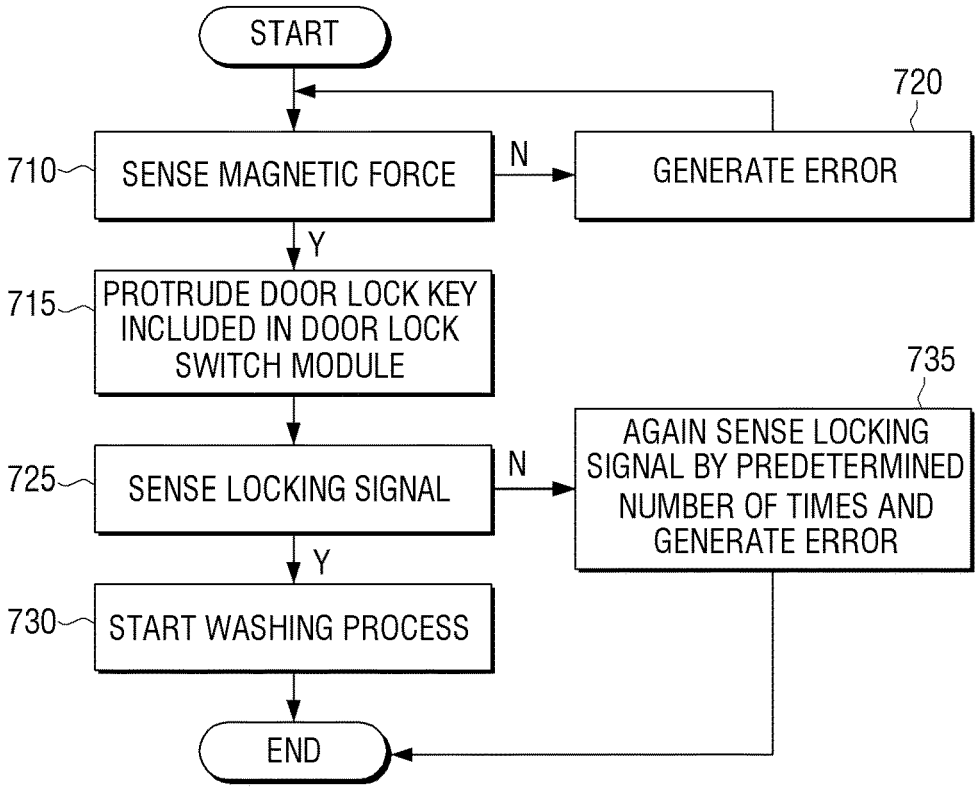
FIGS. 7A and 7B are flowcharts for describing processes in which the washing machine according to an embodiment confirms whether or not the door is locked.
Figure 7B:
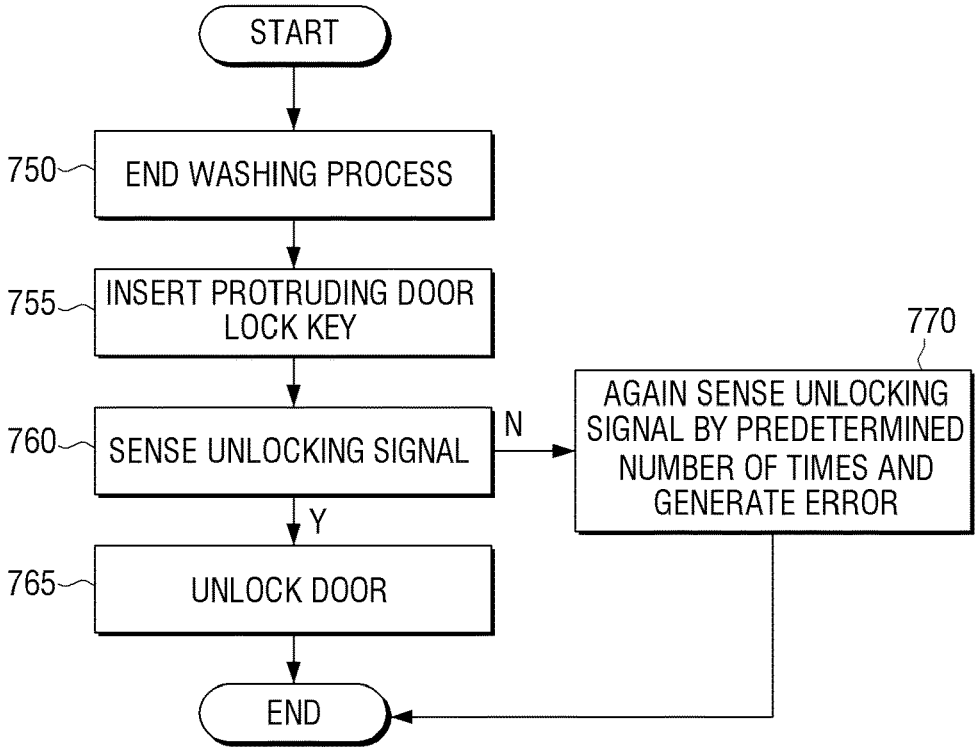

FIGS. 7A and 7B are flowcharts for describing processes in which the washing machine according to an embodiment confirms whether or not the door is locked.

FIG. 7A is a flowchart for describing a process in which the washing machine 10 according to an embodiment confirms whether or not the door is locked while starting a washing process. FIG. 7B is a flowchart for describing a process in which the washing machine 10 according to an embodiment confirms whether or not the door is locked while ending the washing process.

Referring to operating 710, the washing machine 10 may sense a change in a magnetic field using the reed switch included in the door lock switch module to confirm whether or not the door of the washing machine 10 is closed.

Referring to operation 715, when it is confirmed that the door is closed, the washing machine 10 may protrude the door lock bolt to the outside of the door lock switch module. The protrusion of the door lock bolt may include moving the entirety of the door lock bolt to the outside of the door lock switch module and moving a part of the door lock bolt to the outside of the door lock switch module.

Referring to operation 720, when it is not confirmed that the door is closed, the washing machine 10 may generate an error.

Referring to operation 725, the washing machine 10 may confirm whether or not the locking signal is generated. The locking signal may be generated, for example, when the moving contact moving in conjunction with the movement of the door lock bolt releases electrical connection with the contact sensing the unlocked state and is electrically connected to the contact sensing the locked state, and at the same time, the switch electrically connected in series to the contact sensing the locked state is short-circuited on the basis of the approach of the magnetic body included in the door.

As described above, the washing machine 10 may confirm the locked state of the washing machine door using a two-step confirming operation.

Referring to operation 730, the washing machine 10 confirming that the locking signal is generated may start the washing process.

Referring to operation 735, when the locking signal is not generated, the washing machine 10 may confirm whether or not the locking signal is generated and received by a predetermined number of times and then generate an error indicating that the door is not locked.

Referring to operation 750, the washing machine 10 may end the washing process.

Referring to operation 755, when the washing process ends, the washing machine 10 may insert the protruding door lock bolt into the door lock switch module. The insertion of the door lock bolt may include moving the entirety of the door lock bolt to the inside of the door lock switch module and moving a part of the door lock bolt to the inside of the door lock switch module.

Referring to operation 760, the washing machine 10 may confirm whether or not the unlocking signal is generated. The unlocking signal may be generated, for example, when the moving contact moving in conjunction with the movement of the door lock bolt releases electrical connection with the contact sensing the locked state and is electrically connected to the contact sensing the unlocked state.

Referring to operation 765, the washing machine 10 confirming that the unlocking signal is generated may become the unlocked state of the door.

Referring to operation 770, when the unlocking signal is not generated, the washing machine 10 may confirm whether or not the unlocking signal is generated and received by a predetermined number of times and then generate an error indicating that the door is not unlocked.

At least some of devices (for example, modules or functions thereof) or methods (for example, operations) according to various embodiments may be implemented by an instruction stored in a computer-readable storage medium (for example, a memory) in a form of a program module. In a case in which the instruction is executed by a processor (for example, a processor), the processor may perform a function corresponding to the instruction. The computer-readable storage medium may include a hard disk, a floppy disk, and a magnetic medium (for example, a magnetic tape), an optical medium (for example, a compact disk read only memory (CD-ROM) or a digital versatile disk (DVD)), a magneto-optical medium (for example, a floptical disk), an embedded memory, and the like. The instruction may include a code generated by a compiler or a code that can be executed by an interpreter. Modules or program modules according to various embodiments may include one or more of the components described above, may not include some of the components described above, or may further include other components. Operations performed by the modules, the program modules, or the other components according to various embodiments may be executed in a sequential manner, a parallel manner, an iterative manner, or a heuristic manner, at least some of the operations may be performed in a different order or be omitted, or other operations may be added.

The invention claimed is:

1. A washing machine comprising:

a washing machine door;

a washing machine inlet configured to be opened and closed by movement of the washing machine door;

a door lock switch module provided in the washing machine inlet to prevent separation of the washing machine door from the washing machine inlet and configured to include a door lock bolt movable to an inside of the washing machine door, a first switch that is closed when the door lock bolt moves to a locking position in which the door lock bolt protrudes to an outside of the door lock switch module, a second switch that is connected in series with the first switch and is closed when a magnetic body, included in the washing machine door, approaches the door lock switch module, a third switch that is connected in parallel with the first switch and is open when the door lock bolt moves to the locking position, and a moving contact mechanically interworked with the door lock bolt; and a processor configured to control the washing machine to perform a washing process, wherein the first switch includes a first switch contact and the third switch includes a third switch contact, wherein when the door lock bolt moves to the locking position, the moving contact is in contact with the first switch contact so that the first switch is closed and the moving contact is not in contact with the third switch contact so that the third switch is open, and wherein when the first switch and the second switch are both closed and the third switch is open, the processor identifies that the washing machine door is locked by the door lock bolt and controls the washing machine to perform the washing process.

2. The washing machine as claimed in claim 1, wherein the processor is configured to control the washing machine to perform the washing process when it is identified that the washing machine door is locked, on the basis of a signal generated according to the closure of the first switch and the second switch.

3. The washing machine as claimed in claim 2, wherein the processor is configured to control the washing machine to output a washing machine error signal when the signal is not generated, in a case in which the door lock bolt moves to the inside of the washing machine door.

4. The washing machine as claimed in claim 1, wherein the processor is configured to detect that the washing machine door is unlocked on the basis of reception of a signal generated by closure of the third switch.

5. The washing machine as claimed in claim 1, wherein the door lock switch module includes a reed switch actuated on the basis of opening and closing of the washing machine door, and the processor is configured to cause the door lock bolt to move to the locking position when a signal generated by the actuation of the reed switch is received, thereby locking the washing machine door.

6. The washing machine as claimed in claim 1, further comprising a top cover in which the washing machine inlet is formed, wherein the washing machine door is hinge-coupled to one side of the top cover to open and close the washing machine inlet.

7. The washing machine as claimed in claim 6, wherein the door lock switch module is installed at another side of the top cover on which the washing machine door is seated.

8. The washing machine as claimed in claim 6, wherein the magnetic body is positioned at one end of the washing machine door adjacent to a position of the door lock switch module in a case in which the washing machine door is seated on the top cover.

9. The washing machine as claimed in claim 1, wherein the washing machine door includes a block member blocking the movement of the door lock bolt, and the block member is provided at an inner side of a front of the washing machine door.

10. A method for controlling a washing machine including a door, the method comprising:

moving a door lock bolt included in a door lock switch module to a locking position;

confirming a locking signal generated according to a closure of a first switch as the door lock bolt protrudes to an outside of the door lock switch module and moves to the locking position, a closure of a second switch connected to the first switch in series according to an approach of a magnetic body, provided in the door, to the door lock switch module, and an opening of a third switch, connected to the first switch in parallel according to the protruding of the door lock bolt; and identifying that the door is locked and performing a washing process when both the first switch and the second switch are closed and the third switch is open, wherein the door lock switch module further includes a moving contact mechanically interworked with the door lock bolt, wherein the first switch includes a first switch contact and the third switch includes a third switch contact, and wherein when the door lock bolt moves to the locking position, the moving contact is in contact with the first switch contact so that the first switch is closed and the moving contact is not in contact with the third switch contact so that the third switch is open.

11. The method as claimed in claim 10, further comprising generating an error signal in a case in which the locking signal is not received, after the door lock bolt moves to the locking position.

12. The method as claimed in claim 10, wherein the method further comprises detecting that the door is unlocked on the basis of reception of a signal generated by closure of the third switch when the door lock bolt is moved to an unlocking position.

13. The method as claimed in claim 10, wherein the washing machine further includes a reed switch actuated on the basis of opening and closing of the door, the method further comprising moving the door lock bolt to the locking position when a signal generated by the actuation of the reed switch is received.

* * * * *